US005707337A

United States Patent [19]

Franz

[11] Patent Number: 5,707,337

[45] Date of Patent: Jan. 13, 1998

[54] INCUBATOR FOR INFANTS

[75] Inventor: Wolfgang Franz, Lübeck, Germany

[73] Assignee: Drägerwerk Aktiengesellschaft, Lübeck, Germany

[21] Appl. No.: 679,905

[22] Filed: Jul. 15, 1996

[30] Foreign Application Priority Data

Jul. 18, 1995 [DE] Germany ..... 195 26 103.8

[51] Int. Cl.[6] ..... A61G 11/00

[52] U.S. Cl. ..... 600/22

[58] Field of Search ..... 600/21, 22

[56] References Cited

U.S. PATENT DOCUMENTS 2,633,842 4/1953 Higgs ..... 600/22

3,470,866 10/1969 Gittelson ..... 600/22

4,846,783 7/1989 Koch et al. .

4,936,824 6/1990 Koch et al. ..... 600/22

5,100,375 3/1992 Koch .

*Primary Examiner*—Lee S. Cohen

*Assistant Examiner*—Samuel Gilbert

*Attorney, Agent, or Firm*—Walter Ottesen

[57] ABSTRACT

The invention directed to an incubator for infants and includes an air guidance system which extends about the support surface 7 and effects a uniform temperature distribution. This uniform temperature distribution is achieved in that the heated air is moved via a fan 8 so that it rises between the incubator hood 2 and the inner wall 4 and thereafter descends between the inner wall 4 and the support surface 7.

4 Claims, 2 Drawing Sheets

INCUBATOR FOR INFANTS

FIELD OF THE INVENTION

The invention relates to an incubator for infants and a method for conducting air in the incubator.

BACKGROUND OF THE INVENTION

Incubators function to provide medical care for infants and newborns, and especially for prematures. An important task of the incubator is to supply fresh air and to maintain the temperature of the newborn. For this purpose, the incubator air should be adjustable with respect to temperature, oxygen content and air humidity within certain limits and thereafter, these parameters should be maintained constant.

Very high requirements are imposed especially with respect to the stability of temperature and the uniform distribution of temperature in the region of the supporting surface of the infant. This applies to an incubator which is closed as well as during necessary treatment and care measures which must be carried out on the patient. For this purpose, openings such as access openings or even larger flaps, must be opened in order to facilitate manual access to the infant. In general, an air recirculating system is provided wherein the air is recirculated by at least one fan and is heated by means of a heating device. Also, appropriate devices are provided for adding moisture and for enriching the air with oxygen.

U.S. Pat. No. 4,846,783 discloses an incubator wherein a recirculating air system is described which maintains a stable incubator air temperature when the hood is closed and reduces heat loss. The buildup of a stable warm air curtain is facilitated in this incubator when the front wall of the hood is opened. For this purpose, the air outlet is arranged along the front wall and the air inlet is arranged along the opposite lying rear wall.

U.S. Pat. No. 5,100,375 is intended to provide an optimal constancy of temperature over the supporting surface for the infant in that the supporting surface is surrounded on all sides by air supply openings and an air return channel extends completely in the interior space of the incubator hood.

SUMMARY OF THE INVENTION

It is an object of the invention to improve the air conductance about the supporting surface for the infant so that a uniform temperature distribution is obtained.

The incubator of the invention is for an infant and includes: a base; an incubator hood seated on the base and defining an enclosed space; a support member defining a support surface for the infant and being disposed within the enclosed space; an inner wall within the enclosed space arranged parallel to and in spaced relationship to the hood so as to define a first channel therewith; the inner wall extending peripherally around and in spaced relationship to the support member so as to define a second channel therewith; a blower mounted below the support member for imparting movement to the air within the enclosed space; and, the inner wall being interrupted in the region of the blower and in the region above the support surface to permit air to pass through the first and second channels and circulate within the enclosed space.

According to the method of the invention, the air warmed by the heater circulates by moving the air via the fan so that the air rises between the hood and the inner wall and then descends between the inner wall and the supporting surface on which the infant is placed.

A significant advantage of the invention is that the circulating air conductance takes place uniformly on all sides about the supporting surface. This is preferably achieved in that the recirculating air is drawn by suction about the supporting surface via a suitable blower such as a fan wheel. In this way, the air return channel described in U.S. Pat. No. 5,100,375 is avoided. This air return channel affects manipulation as well as the view in the incubator. Furthermore, cleaning the channel is difficult and there are certain space problems at the lower region of this channel where the channel conducts the air to the fan wheel. These disadvantages are overcome with the incubator and method therefor according to the invention.

An advantageous embodiment of the incubator of the invention is so configured that the inner wall, in its ascending path, terminates above the supporting surface without it being necessary to provide a horizontal section of the inner wall parallel to and above the supporting surface.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
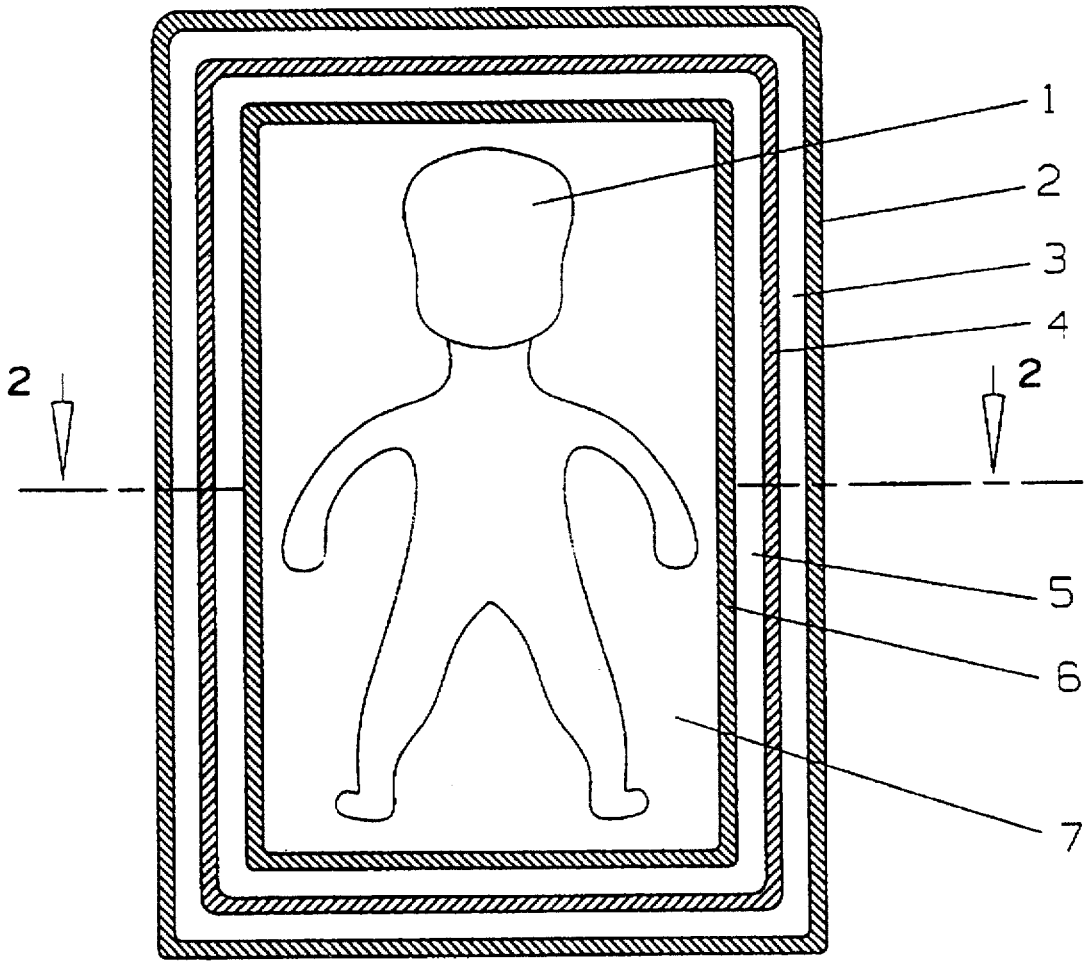
FIG. 1 is a section view of an embodiment of the incubator according to the invention taken along line A–B of FIG. 2.

The newborn 1 is shown in an incubator positioned on a longitudinally extending support surface or cot 7. The support surface 7 is delimited by a holder 6 which, in turn, is connected to the incubator per se. The fan 8 is driven by the motor 9 and is preferably a fan wheel which blows the circulating air 12 over the heater 10 and through the peripherally extending channel 3 between the generally transparent incubator hood 2 and the likewise transparent inner wall 4 into the inner space 13 of the hood 2. The inner wall 4 extends parallel to the hood 2.

The channel space 3 is so arranged that the moving circulating air rises directly on the entire inner surface of the hood wall, as indicated by the upwardly directed flow arrows. The inner wall 4 is attached to the hood 2 and functions to guide the circulating air 12 at the lower region of the wall 4. The upper region of the inner wall 4 as well as the horizontal section 11 of the inner wall 4 are selectively present. The horizontal section 11 extends parallel to the support surface 7. The upper region of the inner wall 4 and the horizontal section 11 thereof conjointly function essentially to reduce the radiation loss of the newborn 1.

What is essential is that the circulating air falls downwardly after reaching the roof of the hood 2 and is drawn downwardly by suction from the suction channel space 5, which extends around the entire support surface 7, and again reaches the fan 8. The peripheral uniform drawing of the circulating air 12 about the entire support surface 7 provides a very uniform temperature distribution in dependence upon the elevation above the support surface 7. The horizontal isotherms are shown by dotted lines in the interior space 13 in FIG. 2. Only slight temperature differences occur in the region of section A–B at the elevation of the newborn 1 as no cooling of the circulating air takes place because of the upwardly extending inner wall 4 and because of the peripherally extending warm air curtain.

The speed of the air in the region of the intake channel space 5 is moderate because the channel space 5 extends longitudinally a long distance in the horizontal direction parallel to the support surface 7. For this reason, the speed of the air in the region of the newborn 1 is very slight.

A uniform temperature distribution and a low air speed over the support surface 7 are criteria for the quality of an incubator. The peripherally extending air guidance system comprises the fan 8 and the channel spaces 3 and 5. Preferably, the peripherally extending air guidance system is symmetrically arranged in both dimensions of length and width parallel to the support surface 7.

Figure 2:
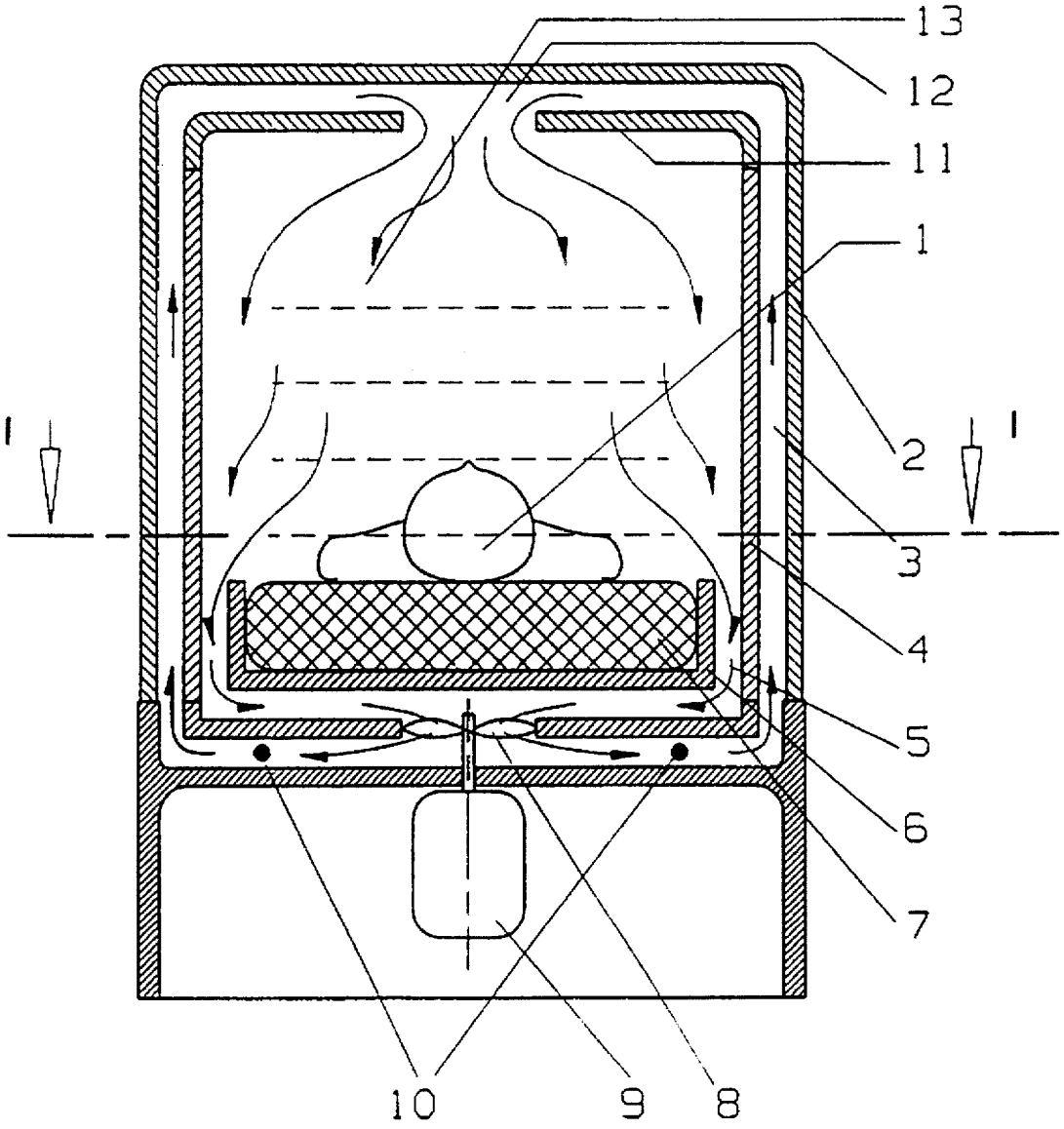
FIG. 2 is a section view of the incubator shown in FIG. 1 taken along line C–D of FIG. 1.

The embodiment of the invention shown in FIGS. 1 and 2 includes the structural features known from the state of the art, such as supply lines for the incubator or access openings which are conventionally provided in the side wall of the hood 2.

It is understood that the foregoing description is that of the preferred embodiments of the invention and that various changes and modifications may be made thereto without departing from the spirit and scope of the invention as defined in the appended claims.

What is claimed is:

1. An incubator for an infant, the incubator comprising:

a base;

an incubator hood seated on said base and defining an enclosed space;

a support member defining a support surface for the infant and being disposed within said enclosed space;

an inner wall within said enclosed space arranged parallel to and in spaced relationship to said hood so as to define a first channel therewith;

said inner wall extending peripherally around and in spaced relationship to said support member so as to define a second channel therewith;

a blower mounted in a region below said support member for imparting movement to the air within said enclosed space; and, said inner wall being interrupted in the region of said blower and in the region above said support surface to permit air to pass through said first and second channels and circulate within said enclosed space.

2. The incubator of claim 1, further comprising a heater arranged in one of said channels for warming the air passing therethrough.

3. The incubator of claim 1, said incubator defining a longitudinally extending center plane perpendicular to said support surface and a transversely extending center plane perpendicular to said support surface and intersecting said longitudinally extending center plane; and, said blower, said hood and said inner wall all being arranged symmetrically with respect to said planes.

4. A method for conducting air in an incubator for an infant, the incubator including: a base; an incubator hood seated on said base and defining an enclosed space; a support member defining a support surface for the infant and being disposed within said enclosed space; an inner wall within said enclosed space arranged parallel to and in spaced relationship to said hood so as to define a first channel therewith; said inner wall extending peripherally around and in spaced relationship to said support member so as to define a second channel therewith; the method comprising the steps of:

providing a blower in a region below said support member and moving said air over a heater to warm the air; and, interrupting said inner wall in the region of said blower and in the region above said support surface to permit the warmed air to rise along said first channel and to then drop toward said support surface and return to said blower via said second channel.

* * * * *